US009899765B2

(12) United States Patent
Wagner

(10) Patent No.: US 9,899,765 B2
(45) Date of Patent: Feb. 20, 2018

(54) LARGE CONDUCTOR INDUSTRIAL PLUG

(71) Applicant: Sentinel Connector Systems, Inc., York, PA (US)

(72) Inventor: Justin Wagner, York, PA (US)

(73) Assignee: Sentinel Connector Systems, Inc., York, PA (US)

( * ) Notice: Subject to any disclaimer, the term of this patent is extended or adjusted under 35 U.S.C. 154(b) by 0 days.

(21) Appl. No.: 15/586,435

(22) Filed: May 4, 2017

(65) Prior Publication Data

US 2017/0324190 A1 Nov. 9, 2017

Related U.S. Application Data

(60) Provisional application No. 62/331,485, filed on May 4, 2016.

(51) Int. Cl.

| | |
|---|---|
| ***H01R 4/50*** | (2006.01) |
| ***H01R 13/625*** | (2006.01) |
| ***H01R 13/58*** | (2006.01) |
| ***H01R 24/64*** | (2011.01) |
| *H01R 107/00* | (2006.01) |

(52) U.S. Cl.
CPC ..... *H01R 13/582* (2013.01); *H01R 24/64* (2013.01); *H01R 2107/00* (2013.01)

(58) Field of Classification Search
CPC ..... H01R 24/62; H01R 24/64; H01R 13/6464
USPC ..... 439/344, 676
See application file for complete search history.

(56) References Cited

U.S. PATENT DOCUMENTS

| | | | | |
|---|---|---|---|---|
| 4,601,530 | A * | 7/1986 | Coldren | H01R 24/62 439/460 |
| 4,607,905 | A * | 8/1986 | Vaden | H01R 4/2429 439/344 |
| 5,269,705 | A | 12/1993 | Iannella et al. | |
| 5,571,035 | A * | 11/1996 | Ferrill | H01R 24/64 439/676 |
| 5,628,647 | A * | 5/1997 | Rohrbaugh | H01R 13/6463 439/404 |
| 5,899,770 | A * | 5/1999 | Ezawa | H01R 13/6463 439/418 |
| 6,080,007 | A * | 6/2000 | Dupuis | H01R 13/6467 439/418 |
| 6,083,052 | A * | 7/2000 | Adams | H01R 13/6461 439/418 |
| 6,250,968 | B1 | 6/2001 | Winings | |

(Continued)

FOREIGN PATENT DOCUMENTS

| | | |
|---|---|---|
| JP | 2003015902 A | 1/2003 |
| KR | 20140022736 | 2/2014 |

OTHER PUBLICATIONS

International Search Report dated Jul. 19, 2017 filed in PCT/US2017/031055; 5 pgs.

(Continued)

*Primary Examiner* — Hae Moon Hyeon
(74) *Attorney, Agent, or Firm* — Vedder Price P.C.

(57) ABSTRACT

A communication plug including a plug body, a cavity in the plug body, the cavity having a first portion, a second portion and a third portion, a load bar having a plurality of openings on a front face of the load bar, where the cavity is sized to engage the load bar such that the load bar directs at least one wire inserted into a corresponding opening in the load bar into channels in the plug.

19 Claims, 2 Drawing Sheets

(56) References Cited

U.S. PATENT DOCUMENTS 6,280,232 B1 * 8/2001 Beecher ..... H01R 24/64 439/418
6,358,092 B1 * 3/2002 Siemon ..... H01R 13/6589 439/418
6,558,204 B1 * 5/2003 Weatherley ..... H01R 13/6467 439/344
6,579,116 B2 * 6/2003 Brennan ..... H01R 13/6461 439/418
6,663,423 B2 12/2003 Belopolsky et al.
6,811,445 B2 * 11/2004 Caveney ..... H01R 13/514 439/676
7,018,242 B2 3/2006 Brown et al.
7,252,554 B2 7/2007 Caveney et al.
7,357,683 B2 4/2008 Caveney et al.
7,364,470 B2 4/2008 Hashim
7,402,085 B2 7/2008 Hammond, Jr. et al.
7,452,246 B2 11/2008 Caveney et al.
7,544,088 B2 6/2009 Caveney et al.
7,601,034 B1 10/2009 Aekins et al.
7,618,296 B2 11/2009 Caveney
7,670,193 B2 3/2010 Millette et al.
7,736,195 B1 6/2010 Poulsen et al.
7,823,281 B2 11/2010 Caveney et al.
7,824,231 B2 11/2010 Marti et al.
7,837,513 B2 11/2010 Millette et al.
7,850,492 B1 12/2010 Straka et al.
7,857,667 B1 12/2010 Wang
7,874,879 B2 1/2011 Caveney et al.
7,905,753 B2 3/2011 Siev et al.
7,909,649 B2 3/2011 Laroche
7,914,345 B2 3/2011 Bopp et al.
7,967,645 B2 6/2011 Marti et al.
8,011,972 B2 9/2011 Caveney et al.
8,047,879 B2 11/2011 Hashim
8,052,483 B1 11/2011 Straka et al.
8,083,551 B2 12/2011 Hetzer et al.
8,262,415 B2 9/2012 Caveney et al.
8,287,317 B2 10/2012 Straka et al.
8,303,348 B2 11/2012 Straka et al.
8,435,083 B2 5/2013 Hetzer et al.
8,435,084 B2 5/2013 Caveney et al.
8,550,850 B2 10/2013 Caveney et al.
8,632,362 B2 1/2014 Straka et al.
8,632,367 B2 1/2014 Caveney
8,764,476 B1 7/2014 Ma
8,858,266 B2 10/2014 Robinson
2001/0051455 A1 12/2001 Clement
2002/0006748 A1 1/2002 Tolmie et al.
2002/0191140 A1 12/2002 Eguchi et al.
2004/0116081 A1 6/2004 Crudele et al.
2004/0259411 A1 12/2004 Chen
2005/0181676 A1 8/2005 Caveney et al.
2006/0121792 A1 6/2006 Hashim
2006/0160428 A1 7/2006 Hashim
2007/0015417 A1 1/2007 Caveney et al.
2007/0117469 A1 5/2007 Caveney et al.
2007/0178772 A1 8/2007 Hashim et al.
2007/0190863 A1 8/2007 Caveney et al.
2008/0020652 A1 1/2008 Caveney et al.
2008/0166925 A1 7/2008 Caveney et al.
2009/0242241 A1 10/2009 Takahashi et al.
2010/0041278 A1 2/2010 Bopp et al.
2011/0104933 A1 5/2011 Straka et al.
2012/0122352 A1 5/2012 Caveney
2012/0129404 A1 5/2012 Caveney et al.
2012/0164884 A1 6/2012 Hetzer et al.
2012/0184154 A1 7/2012 Straka et al.
2012/0196488 A1 * 8/2012 Su ..... G02B 6/3817 439/676
2013/0210277 A1 8/2013 Robinson
2013/0288538 A1 10/2013 Caveney et al.
2014/0073196 A1 3/2014 Hashim et al.
2014/0154919 A1 6/2014 Straka et al.

OTHER PUBLICATIONS

International Searching Authority Written Opinion dated Jul. 19, 2017 filed in PCT/US2017/031055; 6 pgs.

* cited by examiner

LARGE CONDUCTOR INDUSTRIAL PLUG

PRIORITY CLAIM

The present disclosure is a Non-Provisional Patent Application claiming the benefit of and priority to U.S. Provisional Patent Application No. 62/331,485, filed on May 4, 2016, which is incorporated by reference herein in its entirety.

BACKGROUND OF THE INVENTION

Many network topologies call for the use of larger insulated conductor wire. Connecting large insulated conductor wire into a plug has presented numerous challenges do to the inability to produce structures capable of engaging the large insulated conductor wire. This lack of structure crates numerous problems with interconnections in a standard network plug, which leads to a issues with data transmission.

A need exists for a plug that provides a method of terminating large conductors into a modular plug in an improved assemble method.

BRIEF SUMMARY OF THE INVENTION

One embodiment of the present disclosure includes a communication plug including a plug body, a cavity in the plug body, the cavity having a first portion, a second portion and a third portion, a load bar having a plurality of openings on a front face of the load bar, where the cavity is sized to engage the load bar such that the load bar directs at least one wire inserted into a corresponding opening in the load bar into channels in the plug.

In another embodiment, a first group of openings are arranged in an upper face of the load bar and a second group of openings are arranged in a lower face of the load bar.

In another embodiment, the first group of openings are at a level higher than the channels in the plug.

In another embodiment, the second group of openings are at a level lower than the channels in the plug.

In another embodiment, the plug includes a plurality of first guides with each guide aligning with a corresponding opening in the upper face of the load bar.

In another embodiment, the plug includes a plurality of second guides with each guide aligning with a corresponding opening in the lower face of the load bar.

In another embodiment, the diameter of the wire is at least 0.056 inches.

In another embodiment, the diameter of the wire is approximately 0.056 inches.

In another embodiment, the diameter of the wire is approximately 0.058 inches.

In another embodiment, the distance between the centers of the first openings is approximately 0.040 inches.

Another embodiment of the present disclosure includes an RJ 45 communication plug including a plug body, a cavity in the plug body, the cavity having a first portion, a second portion and a third portion, a load bar having a plurality of openings on a front face of the load bar, where the cavity is sized to engage the load bar such that the load bar directs at least one wire inserted into a corresponding opening in the load bar into channels in the plug.

In another embodiment, a first group of openings are arranged in an upper face of the load bar and a second group of openings are arranged in a lower face of the load bar.

In another embodiment, the first group of openings are at a level higher than the channels in the plug.

In another embodiment, the second group of openings are at a level lower than the channels in the plug.

In another embodiment, the plug includes a plurality of second guides with each guide aligning with a corresponding opening in the lower face of the load bar.

In another embodiment, the diameter of the wire is at least 0.056 inches.

In another embodiment, the diameter of the wire is approximately 0.056 inches.

In another embodiment, the diameter of the wire is approximately 0.058 inches.

In another embodiment, the distance between openings is between 0.040 and 0.030 inches.

BRIEF DESCRIPTION OF THE SEVERAL VIEWS OF THE DRAWING

Details of the present invention, including non-limiting benefits and advantages, will become more readily apparent to those of ordinary skill in the relevant art after reviewing the following detailed description and accompanying drawings, wherein.

DETAILED DESCRIPTION OF THE INVENTION

Figure 1:
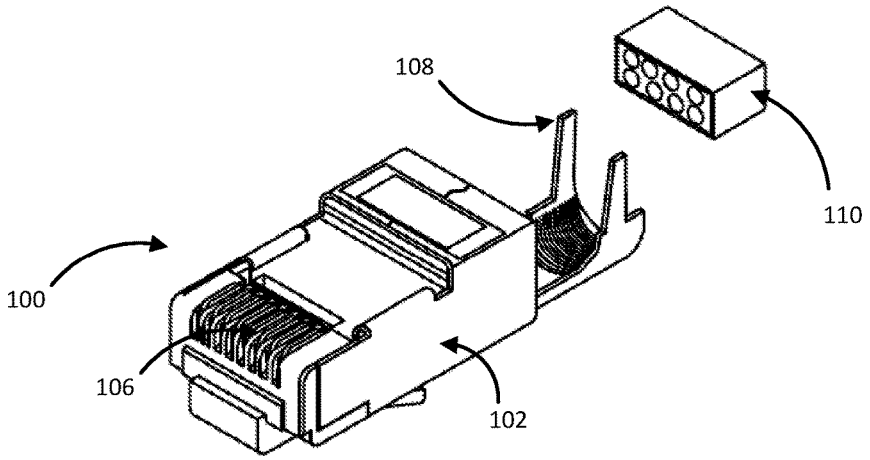
FIG. 1 depicts a one embodiment of a high speed network plug.

FIG. 1 depicts a one embodiment of a high speed network plug 100. The plug 100 includes a plug base 102 and a cover 104 surrounding a portion of the plug base 102. The plug base 102 includes a plurality of pins 106 positioned in channels in made in a top surface of the plug base 102. The cover 104 includes a wire engagement unit 108 positioned on a side of the plug base 102 furthest from the pins 106. The wire engagement unit 108 is configured to engage the exterior surface of a wire inserted into the wire engagement unit 108. The plug 100 includes a load bar 110 that is sized to engage an opening (not shown) in the plug base 102.

Figure 2:
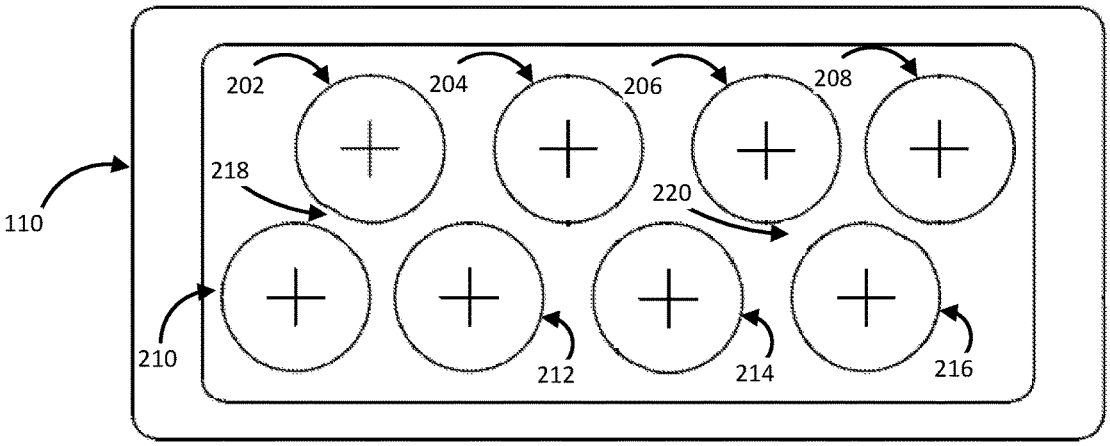
FIG. 2 depicts a front view of the load bar.

FIG. 2 depicts a front view of the load bar 110 of FIG. 1. The load bar 110 includes a plurality of openings 202, 204, 206, 208, 210, 212, 214 and 216 across a front face of the load bar 110. Each of the openings 202, 204, 206, 208, 210, 212, 214 and 216 is sized to accommodate a having diameter of 0.060 in or larger. In another embodiment, each of the openings 202, 204, 206, 208, 210, 212, 214 and 216 is sized to accommodate a having diameter of 0.056 in or larger. Each opening 202, 204, 206, 208, 210, 212, 214 and 216 is separated from an adjacent opening 202, 204, 206, 208, 210, 212, 214 or 216 by a distance. In one embodiment, the distance between openings 202, 204, 206, 208, 210, 212, 214 and 216 is the same for each opening 202, 204, 206, 208, 210, 212, 214 or 216. In another embodiment, the distance between openings 202, 204, 206, 208, 210, 212, 214 and 216 varies. Consistent with this embodiment, the distance 218 between an edge of opening 202 and an edge of opening 210 may be approximately 0.010 inches. The distance 220 between an edge of opening 206 and an edge of opening 216 may be 0.012 inches.

In one embodiment, the distance between center lines of adjacent openings 202, 204, 206, 208, 210, 212, 214 or 216 may be equal. In another embodiment, the distance between center lines of adjacent openings 202, 204, 206, 208, 210, 212, 214 or 216 varies. Consistent with this embodiment, the distance between the center of opening 202 and the center of opening 210 is 0.030 inches, the distance between the center of opening 202 and the center of opening 212 is 0.040 inches, the distance between the center of opening 212 and the center of opening 204 is 0.040 inches, the distance between the center of opening 204 and the center of opening 214 is 0.040 inches, the distance between the center of opening 214 and the center of opening 206 is 0.040 inches, the distance between the center of opening 206 and the center of opening 216 is 0.040 inches and the distance between the center of opening 216 and the center of opening 208 is 0.030 inches.

Figure 3:
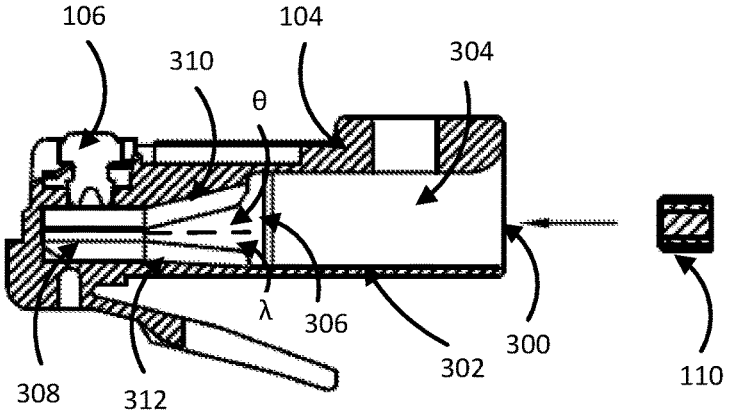
FIG. 3 depicts a side view of the plug.

FIG. 3 depicts a side view of the plug 100. The plug 100 includes an opening 300 and cavity 302 with the cavity 302 having a first portion 304 having a first height, second portion 306 having a second height and a third portion 308 having a third height. The first portion 302 height is substantially the same along the length of the first portion 302. The height of the second portion 306 slopes from the height of the first portion 304 to the height of the third portion 308 along the length of the second portion 306. The opening 300 and cavity 302 are sized to accommodate the load bar 110 such that the load bar 110 passes through the opening 300 into the first portion 304 of the cavity 302. Upper guide 310 and lower guide 312 are positioned on an upper and lower surface of the cavity 302 in the second portion 306 and third portion 308. The guides 310 and 312 are formed to create channels that accommodate individual cables of a wire such that the cables are positioned underneath a respective pin 106 when a wire is inserted into the plug 100.

The opening 300 and first portion 304 of the cavity 302 are sized to accommodate the load bar 110 such that the front face of the load bar 110 engages the ends of the guides 310 in the second portion 306 of the cavity 302. The openings 202, 204, 206, 208, 210, 212, 214 and 216 in the load bar 110 are positioned such that a wire inserted into each opening 202, 204, 206, 208, 210, 212, 214 and 216 is guided into a specific channel created by the guides 310 and 312. The upper guides 310 are angled from the horizontal by an angle θ and the lower guides are angled from the horizontal by an angle λ. The guides 310 and 312 act to direct each in the wire from the outlet of the openings 202, 204, 206, 208, 210, 212, 214 and 216 into a respective slot without adjacent s being in contact.

Figure 4:
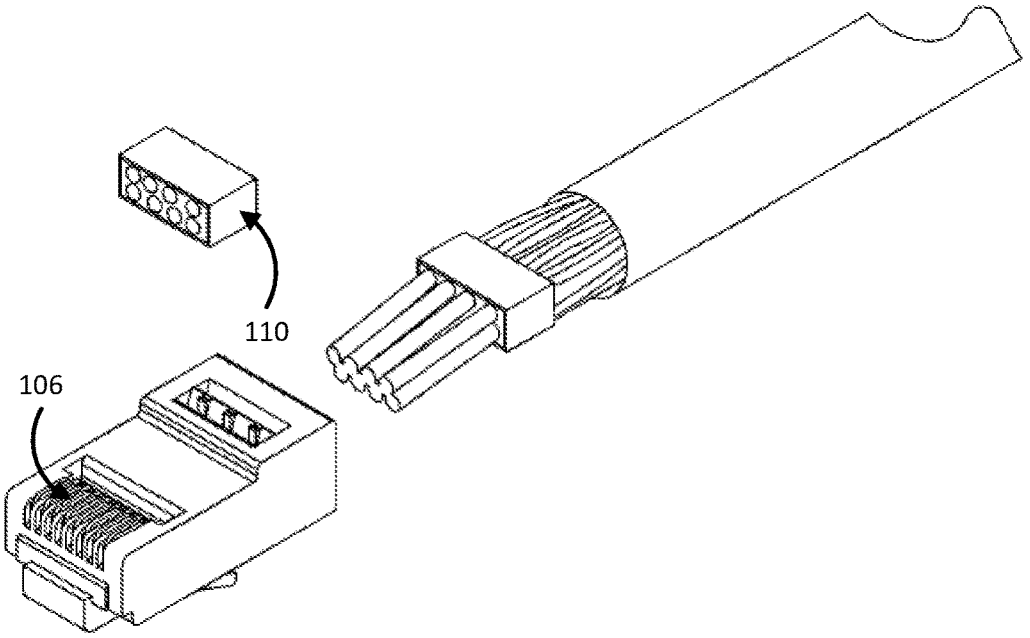
FIG. 4 depicts an exploded view of the plug assembly with a wire inserted into the plug.

FIG. 4 depicts an exploded view of the plug assembly with a wire inserted into the plug. Each of the wires is bent at an angle such that the separation of each wire in the load bar is larger than the vertical separation the s passing through openings 202, 204, 206 and 208 and the s passing through openings 210, 212, 214 and 216 is larger as the s exit the load bar 110 than at the entry to the slots in the plug.

In the present disclosure, the words "a" or "an" are to be taken to include both the singular and the plural. Conversely, any reference to plural items shall, where appropriate, include the singular.

It should be understood that various changes and modifications to the presently preferred embodiments disclosed herein will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A communication plug including:

a plug base;

a cavity in the plug base, the cavity having a first portion, a second portion and a third portion with a plurality of channels extending in the third portion of the cavity;

a load bar having a plurality of openings;

a plurality of first guides in the second portion of the plug base with each guide aligning with a corresponding opening in the load bar, wherein the cavity is sized to engage the load bar such that the load bar directs each of a plurality of cables inserted into a corresponding opening in the load bar into a corresponding channel in the third portion of the cavity.

2. The communication plug of claim 1 wherein a first group of openings are arranged in an upper face of the load bar and a second group of openings are arranged in a lower face of the load bar.

3. The communication plug of claim 2 wherein the first group of openings are at a level higher than the channels in the cavity.

4. The communication plug of claim 2 wherein the second group of openings are at a level lower than the channels in the cavity.

5. The communication plug of claim 4 including a plurality of second guides in the second portion of the cavity base with each guide aligning with a corresponding opening in the load bar.

6. The communication plug of claim 1 wherein the diameter of the wire is at least 0.056 inches.

7. The communication plug of claim 1 wherein the diameter of the wire is approximately 0.056 inches.

8. The communication plug of claim 1 wherein the diameter of the wire is approximately 0.058 inches.

9. The communication plug of claim 1 wherein the distance between the centers of the first openings is approximately 0.040 inches.

10. An RJ 45 communication plug including:

a plug base;

a cavity in the plug base, the cavity having a first portion, a second portion and a third portion with a plurality of channels extending in the third portion of the cavity;

a load bar having eight openings;

a plurality of first guides in the second portion of the plug base with each guide aligning with a corresponding opening in the load bar, wherein the cavity is sized to engage the load bar such each of the eight openings in the load bar directs a cable inserted into a corresponding opening in the load bar into a corresponding channel in the third portion of the cavity.

11. The RJ 45 communication plug of claim 10 wherein a first group of openings are arranged in an upper face of the load bar and a second group of openings are arranged in a lower face of the load bar.

12. The RJ 45 communication plug of claim 11 wherein the first group of openings are at a level higher than the channels in the cavity.

13. The RJ 45 communication plug of claim 12 including a plurality of first guides in the third portion of the cavity with each guide aligning with a corresponding opening in the load bar.

14. The RJ 45 communication plug of claim 11 wherein the second group of openings are at a level lower than the channels in the cavity.

15. The RJ 45 communication plug of claim 14 including a plurality of second guides in the third portion of the cavity with each guide aligning with a corresponding opening in the lower face of the load bar.

16. The RJ 45 communication plug of claim 10 wherein the diameter of the wire is at least 0.056 inches.

17. The RJ 45 communication plug of claim 10 wherein the diameter of the wire is approximately 0.056 inches.

18. The RJ 45 communication plug of claim 10 wherein the diameter of the wire is approximately 0.058 inches.

19. The RJ 45 communication plug of claim 10 wherein the distance between openings is between 0.040 and 0.030 inches.

* * * * *